US005375980A

United States Patent [19]

Johst et al.

[11] Patent Number: 5,375,980

[45] Date of Patent: Dec. 27, 1994

[54] HOUSING CONFIGURATION FOR HELICAL BLADED FLUID RING PUMP

[75] Inventors: Willy Johst, Aalborg; Henrik Elsass, Hellerup, both of Denmark

[73] Assignee: Berendsen Teknik A/S, Soborg, Denmark

[21] Appl. No.: 215,196

[22] Filed: Mar. 21, 1994

Related U.S. Application Data

[63] Continuation of Ser. No. 816,495, Dec. 31, 1991, abandoned.

[30] Foreign Application Priority Data

Jan. 2, 1991 [EP] European Pat. Off. ..... 91610001

[51] Int. Cl.[5] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 1,699,327 | 1/1929 | Durdin | 417/67 |
| 2,145,644 | 1/1939 | Brace | 417/68 |

FOREIGN PATENT DOCUMENTS

| | | | |
|---|---|---|---|
| 111653 | 6/1984 | European Pat. Off. | 417/68 |
| 1039765 | 10/1953 | France | 417/68 |
| 1178104 | 5/1959 | France . | |
| 883565 | 7/1953 | Germany | 417/68 |
| 3313446 | 10/1984 | Germany . | |
| 40260 | 3/1913 | Sweden | 417/68 |
| 12359 | 8/1915 | United Kingdom | 417/68 |
| 700487 | 12/1951 | United Kingdom . | |

*Primary Examiner*—Richard A. Bertsch
*Assistant Examiner*—Roland G. McAndrews, Jr.
*Attorney, Agent, or Firm*—Darby & Darby

[57] ABSTRACT

A liquid-ring pump according to the invention for use as a vacuum pump, e.g. for the aspiration of centrifugal pumps, and for use in the transport of fluids, e.g. mixtures of liquids and gases or solid particles, is of the type where the distance between the internal surface (17) of the pump housing and the rotor (10) varies. Seen in section, the surface is divided into two identical, reverse-image sectors, in relation to which the rotor (10) is disposed in a symmetrical manner. In the transition area between the two sectors the internal surface (17) is provided with a substantially flat surface (44) stretching tangentially in relation to the periphery of the rotor (10). Thereby cavitiation problems are reduced.

27 Claims, 7 Drawing Sheets

HOUSING CONFIGURATION FOR HELICAL BLADED FLUID RING PUMP

RELATED APPLICATION

This application is a continuation of application Ser. No. 07/816,495 filed Dec. 31, 1991, now abandoned.

BACKGROUND OF THE INVENTION

Liquid-ring pumps of known type are disclosed in the inventors' U.S. Pat. No. 4,523,893 and GB patent publications 1 425 997 and 1 547 976. These liquid-ring pumps are advantageous for aspiration of centrifugal pumps and for the transport of gases, and for difficult pump media such as liquids mixed with or alternating with gases, foam, inhomogeneous polluting or particle-containing fluids, for volatile liquids such as acetone or in the transport of gases which require isothermic compression.

The above-mentioned publications describe a cylindrical internal surface which surrounds the rotor, and the rotor is disposed eccentrically in relation to the cylinder axis. Moreover, the arcuate inlet aperture is concentric with the axis of rotation and is smaller than the outlet aperture, which is concentric with the inside of the pump housing. During operation, the pump is partly filled with liquid which is hurled around in the housing under centrifugal force and forms a similarly cylindrical liquid ring with a certain thickness out from the surface. For reasons of the eccentric disposition of the rotor, only the edges of the blades are in contact with the liquid on the one side, and on the diametrically opposite side the liquid is in contact with the actual rotor hub by linear or surface contact, which is hereafter referred to as the sealing line or sealing surface. Between the blades there are thus formed several sickle-shaped cavities which extend around the rotor hub and are limited by the liquid ring, the blades and the rotor hub, and in which the gases are pumped forwards by the spiral movement of the rotor blades.

The eccentricity also results in the rotating liquid ring being, to a varying degree, in engagement with the rotor, and is therefore subject to accelerations and decelerations during the movement, where the speed of the liquid is at its lowest at the blades' most submersed position and greatest at that position in which only the outer parts of the blades are in the liquid. In other words, there occurs a deceleration of the liquid ring before the sealing line and an acceleration of the liquid ring after the sealing line. On that side on which a deceleration of the liquid occurs, there is a corresponding increase in its pressure simultaneously with a vortex formation. This pressure, the sealing pressure P1, is determinative for the amount of differential pressure that the pump is able to extend, in that it prevents gases from passing between the hub and the liquid ring against the pump direction. The point for P1 is shown in FIG. 1 of the drawing, where the reference FIG. 2 indicates the pump housing, 4 the blades, 6 the rotor hub, and 8 the liquid. It should be noted that the figure shows in principle a situation at a differential pressure of close to 0.

As a consequence of the sealing pressure, with the known pumps there arises a resulting radial force transversely to the rotational axis of the rotor, and which has to be absorbed in the rotor bearings. In some embodiments of this type of pump, it is desirable to house the rotor in bearings only at one end of the shaft, which limits the pump performance and necessitates a strong bearing construction.

The invention relates to a liquid-ring pump of the kind comprising a rotor provided with helical blades and which is suspended in bearings in a pump housing provided with an inlet aperture and an outlet aperture disposed at each end of the rotor. The distance between the outer diameter of the rotor blades and the inside surface of the housing facing towards the periphery of the rotor varies as seen along the circumference of the rotor. The said internal surface seen in a section at right-angles to the axis of rotation is configured as two or more substantially identical sectors where the rotor with its axis of rotation is placed symmetrically in relation to the sectors.

A such pump is known from U.S. Pat. No. 1,699,327. It is hereby possible to achieve two identical pressure distributions with two sealing pressures placed diametrically opposite around the rotor spindle, whereby the resulting power component transversely to the rotational axis of the rotor becomes zero. Such a pump construction provides the possibility of using a less robust and thus cheaper to manufacture spindle and bearing construction at the rotor, which is of particular significance for rotors which are suspended in bearings at only one end of the spindle.

In the line-shaped transition area between two adjacent sectors on the inner side of the pump housing the sealing surface develops a subpressure implying a danger of cavitation with subsequent damage to the wall of the housing.

The purpose of the present invention is to provide a pump of the known art where the cavitation risk is diminished and where other disadvantages resulting from the joint between the sectors are reduced. Another purpose is to provide anticavitation means that allow the pump housing to be made of semi-cylindrical shells in a simple and cheap way and with different mutual offset by the cylinder axes of the shells.

This purpose is fulfilled by a pump according to the invention of the type with the characteristic features that the internal surface at and seen in the direction of rotation immediately after the transition between adjoining sectors has a substantially plane portion which extends in a substantially tangential manner in relation to the rotor.

Preferred and advantageous embodiments of the pump according to the invention are disclosed.

If the internal surface at the inlet side is configured so that pulsations are suppressed and thus the capacity of the pump is hereby increased.

If the surface at the outlet end is configured as disclosed, the liquid ring is stabilized and a slightly smaller outlet opening is made possible than with pumps without this construction.

With the arrangement according to the invention, the vortex formation in the area with low liquid speed is increased, so that a static vortex arises in front of the place with the clearance reduction respectively the transverse wall portion. The sealing pressure is thus reinforced and the differential pressure can be increased, and the amount of rotating liquid is reduced with a consequent reduction in power consumption. When the pump is used as a liquid transport pump, i.e. almost or completely filled with liquid, the average speed of rotation of the liquid ring is low in relation to the speed of rotation of the rotor, and the use of this construction means that the convolutions function to a higher degree as a worm conveyor which conveys liquid from the suction side to the pressure side of the pump. Thus the achievable end-pressure, i.e. the maximum differential pressure achievable with volumetric flow equal to zero, will be close to theoretical velocity corresponding to the height of the liquid level which can be achieved at speeds equal to the peripheral speed of the rotor, see the equation $h=v^2/2\ g$, where h is the height, v is the speed and g the gravitational force.

The pump according to the invention is used, among other things, for the transport of solid particles such as synthetic granulates in water. Providing that the specific gravity of the solid particles does not exceed approx. 1.5, this transport is effected without any problems, in that the vortices at the sealing surfaces force the particles in between the rotor blades, from where they are transported out through the discharge opening in the so-called pressure plate. When the specific gravity exceeds 1.5, there arises a tendency towards centrifugation, where the particles collect in a ring along the inner side of the rotor housing. This can be countered by placing carriers for the particles as disclosed by the invention.

In connection with the transport of particles, as suggested above the pumping-out of the particles is enhanced if the ends of the rotor and the housing are configured as a truncated cone, whereby the particles are conveyed as in a worm conveyor to the discharge opening, as presented by the invention.

With configurations of the pump in which the rotor does not end as truncated cone, the pump is used for tasks where the demands for the maximum differential pressure is limited to 200–300 mbar. The necessary sealing pressure is therefore correspondingly limited, and can consequently be achieved with a reduced amount of liquid with the hereto corresponding lower consumption of power. This is achieved by increasing the diameter of the discharge opening, which is the bore in the pressure plate, approximately corresponding to the diameter of the rotor hub, and at the same time provide a coverplate with a larger diameter than the rotor hub at the end of the rotor. During operation there is hereby created a rotating liquid lock, which ensures that the liquid ring is of such a thickness that at a differential pressure equal to zero it just touches the rotor hub.

In an embodiment of the invention there is provided extended blade portions at the outlet end of the rotor, the extensions stretching mainly perpendicularly to the axis of rotation of the rotor. Hereby an unwanted excessive liquid flow through the pump may be reduced.

With one embodiment, the result is that instead of being exposed to a strong braking effect, the liquid ring can deflect and continue into the cells, where it compresses the air which will always exist in the cells. Consequently, the cells come to serve as an accumulator for a part of the liquid ring's energy, which is released again when the liquid ring has passed the sealing line, and thus together with the less disturbed process of flow it contributes towards a smaller power requirement.

A particularly simple and inexpensive way in which to make the cells will appear from a description of the invention, in that the solid hub has a relatively small diameter, and therefore has relatively high blades between which there are disposed axial laminations of less height. The diameter across the outer edges of the laminations corresponds to the normal diameter of the hub.

Knives on the rotor hub for cutting large solid particles into lesser particles may be provided in a further embodiment of the invention.

DESCRIPTION OF THE DRAWINGS

Embodiments of the invention will now be described in closer detail with reference to the drawing, where.

DESCRIPTION OF ILLUSTRATIVE EMBODIMENTS

Figure 1:
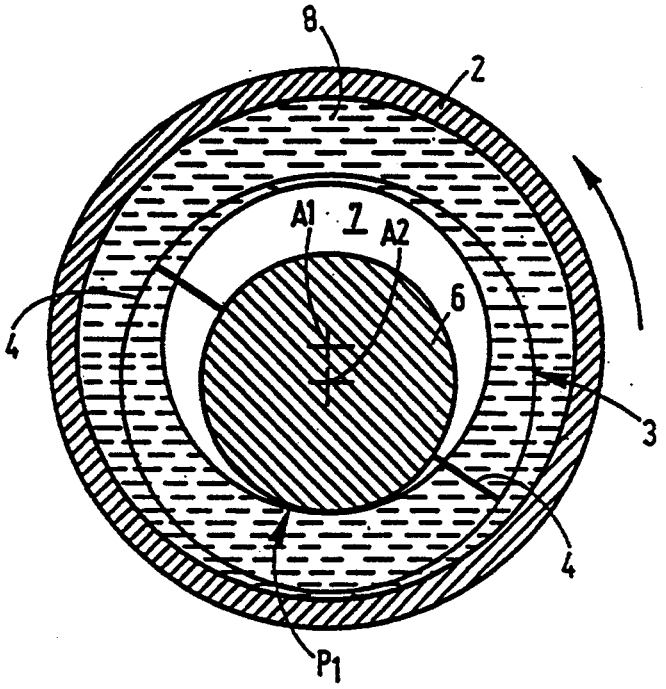
FIG. 1 PRIOR ART
FIG. 1 shows a section through a liquid-ring pump of the known kind during operation and at a differential pressure close to 0.

A liquid-ring pump of the known kind as seen in FIG. 1 has a pump housing 2 with an axis of symmetry A1, and in which there is suspended a rotor 3 with two spiral-formed blades 4 secured around a rotor shaft 6 having an axis of rotation A2 which is offset in relation to the line A1. During operation, the liquid 8 forms a ring which, at a line or surfaces, touches the shaft 6, and whereby a cavity 7 containing gases is shut off.

Figure 2:
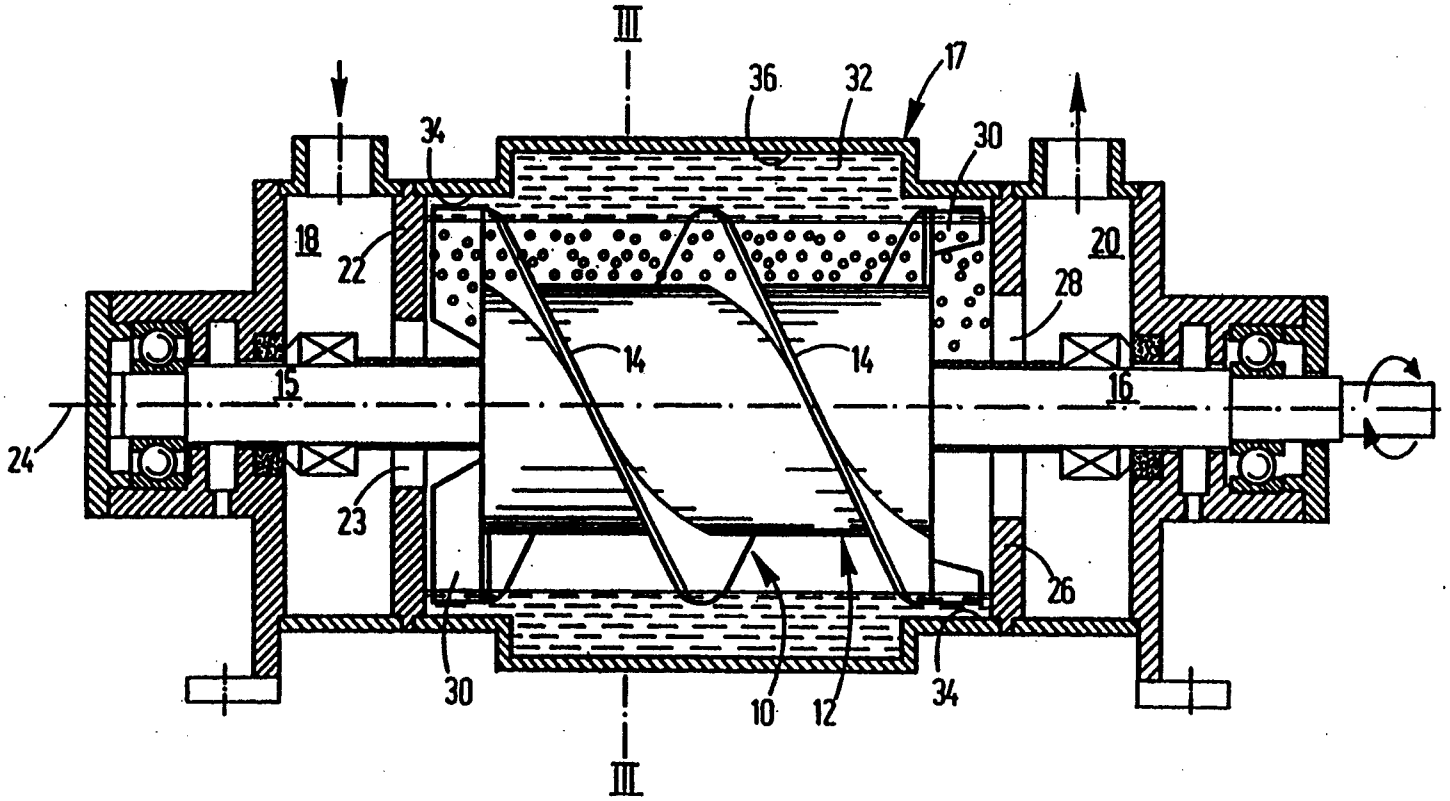
FIG. 2 shows a section through a preferred embodiment of the pump according to the invention.

A preferred embodiment of the pump according to the invention is seen in FIG. 2. This has a cylindrical rotor 10 with hub 12 provided with two blades 14 which extend as helical convolutions 360° around the hub 12. The rotor 10 is suspended at its shaft ends 15 and 16 in the pump housing, which has an inlet chamber 18 on the suction side and an outlet chamber 20 on the pump's pressure side. Between the chamber 18 and the rotor 10, in a separating wall 22 called the suction plate, there is provided a circular inlet opening 23 which is concentric with the axis of rotation 24 of the rotor. A corresponding separating wall 26, called the pressure plate, with circular outlet opening 28, is provided in the outlet chamber 20. The opening 28 is also concentric with the axis 24 and is larger than the opening 23, preferably 10–20 mm smaller in diameter than the hub 12 of the rotor. This is in order to create the necessary sealing pressure when the pumps involved are vacuum pumps.

In this embodiment, the ends of the rotor are not shut off in the area between the blades 14 and have vanes 30 to assist the movement of the liquid ring 32. In the area of the rotor ends, the housing 17 has internal cylindrical surfaces 34 concentric with the axis 24.

Figure 3B:
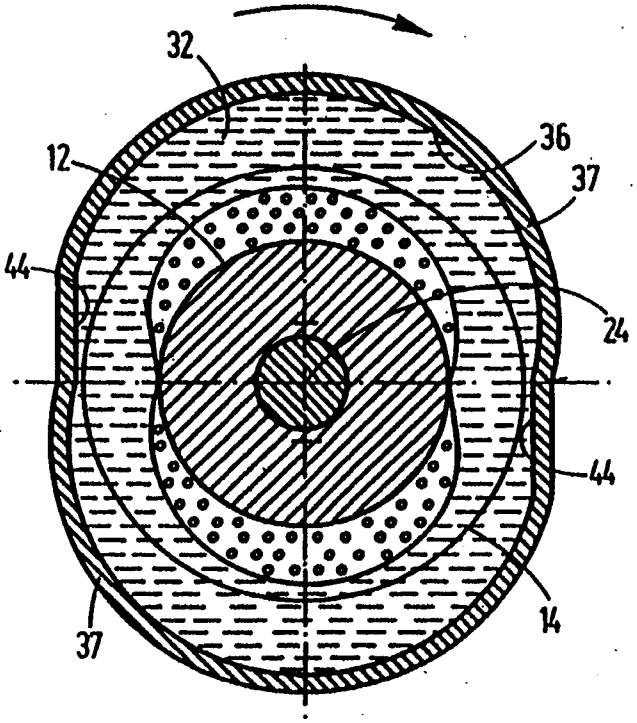
FIG. 3*a* and 3*b* shows two variants of a section along the line III—III in FIG. 2.
Figure 3A:
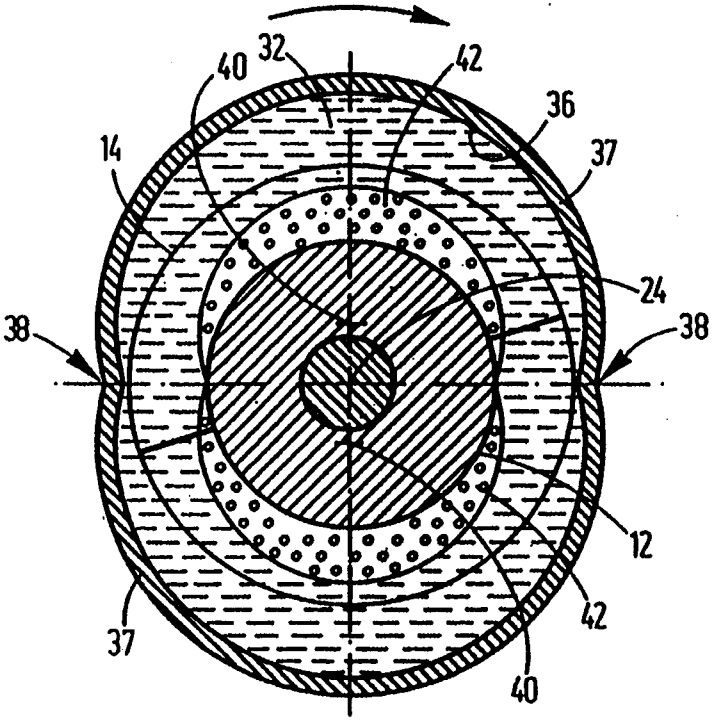

Over the main part of the internal surface 36 which faces towards the rotor 10, said surface 36 is configured as shown in FIG. 3*a* and 3*b*, i.e. it comprises two partly cylindrical shells 37 with centrelines 40 which are offset in relation to the axis 24. FIG. 3*a* does not show an embodiment according to the invention, but is included for explanatory purposes. The shells 37 are welded together at the lines 38, and whereby the space around the rotor 10 assumes the shape of two equally-formed sectors which arch outwards on opposite sides of the rotor 10. Forms other than partly cylindrical can be envisaged for the surface 36, for example partly elliptical or other substantially continuous curved surfaces.

The smallest clearance between the outer edges of the blades 14 and the surface 36 can be 1–2 mm, or adapted to the size of the solid particles which are to be conveyed. The largest clearance between the surface 36 and the edges of the blades is smaller than or equal to the height of the blades 14 from the surface of the hub 12.

During operation at a differential pressure equal to zero, there arises the shown situation in which two cavities 42 are formed which carry gases through the pump.

To reduce the risk of cavitation immediately after the joint 38 seen in the direction of circulation, a part of the shells 37 is configured as a tangentially-oriented surface 44 in relation to the axis of rotation 24, see FIG. 3*b* for the preferred embodiment. By having a plane surface 44 it is possible in a simple way that is also cheap to perform to make the pump according to the invention. Hereby semi-cylindrical shells are slightly mutually displaced as shown in FIG. 3*b* and connected by flat pieces making up the surfaces 44.

According to not shown embodiments of the inventions, three or more sectors or shells may be combined.

Figure 4:
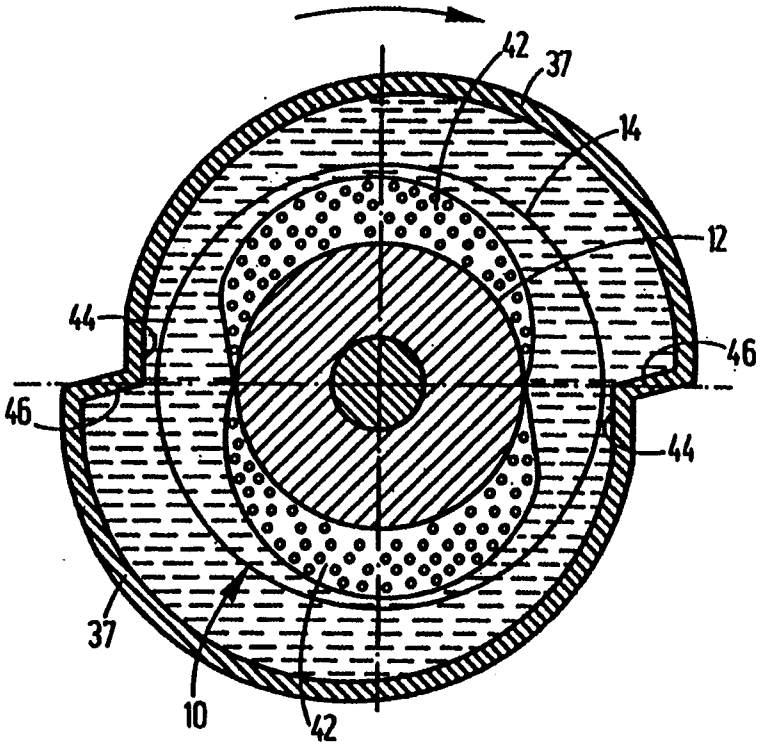
FIG. 4 shows a section through a variant of pump housing and rotor.

FIG. 4 shows an embodiment of the rotor housing which gives rise to a strong braking effect on the liquid ring in the area around the sealing surface. The partly cylindrical shells are mutually displaced sideways, and the resulting interval is covered with transverse plate pieces 46. In this case, the lower circulation speed of the liquid ring gives rise to a higher sealing pressure, and hereby a greater differential pressure for the pump, which is of particular significance when pumping mixtures of liquid and gases and strongly foaming fluids. As liquid conveyor pumps, these embodiments result in a reduction in the rotation of the liquid, and the blades 14 of the rotor function to a higher degree as an ordinary worm conveyor with regard to the liquid, whereas the gases are pressed in towards the hub 12 for reasons of the difference in specific gravity.

Figure 5:
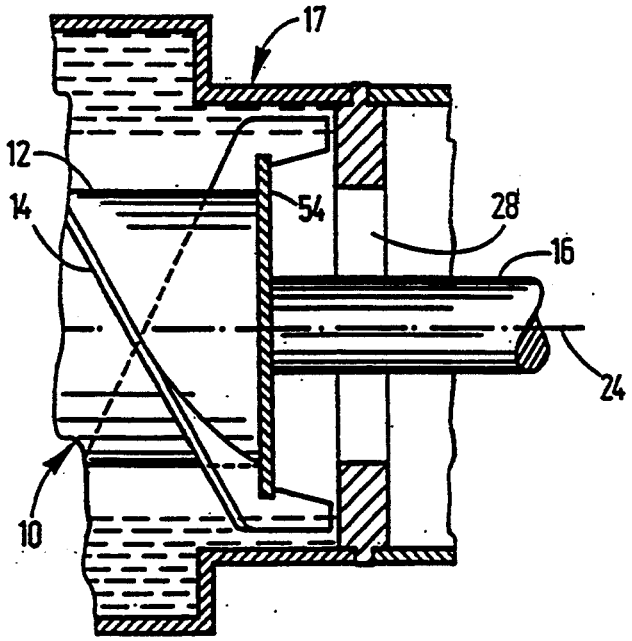
FIG. 5 shows a part-section through the pump in a variant of the first embodiment with coverplate at the end of the rotor.

FIG. 5 shows a partial section through a pump according to the invention in the area of the discharge opening, and for use in applications where the requirements regarding maximum differential pressure are limited to 200–300 mbar. The necessary sealing pressure can therefore be correspondingly reduced. Consequently, this can be achieved with a reduced amount of liquid with correspondingly less power consumption. This is achieved by making the diameter of the discharge opening 28 about the same as the diameter of the hub 12, while at the same time providing the end of the rotor with an end-plate 54 with a diameter which is greater than the diameter of the hub, but less than the outer diameter of the rotor 10 across the edges of the blades 14. There is hereby created a kind of rotating liquid lock, which ensures that the liquid ring is of such a thickness that at a differential pressure equal to zero, it just touches the hub of the rotor. The gases which are conveyed through the pump can pass between the edge of the plate 54 and the liquid ring.

Figure 6:
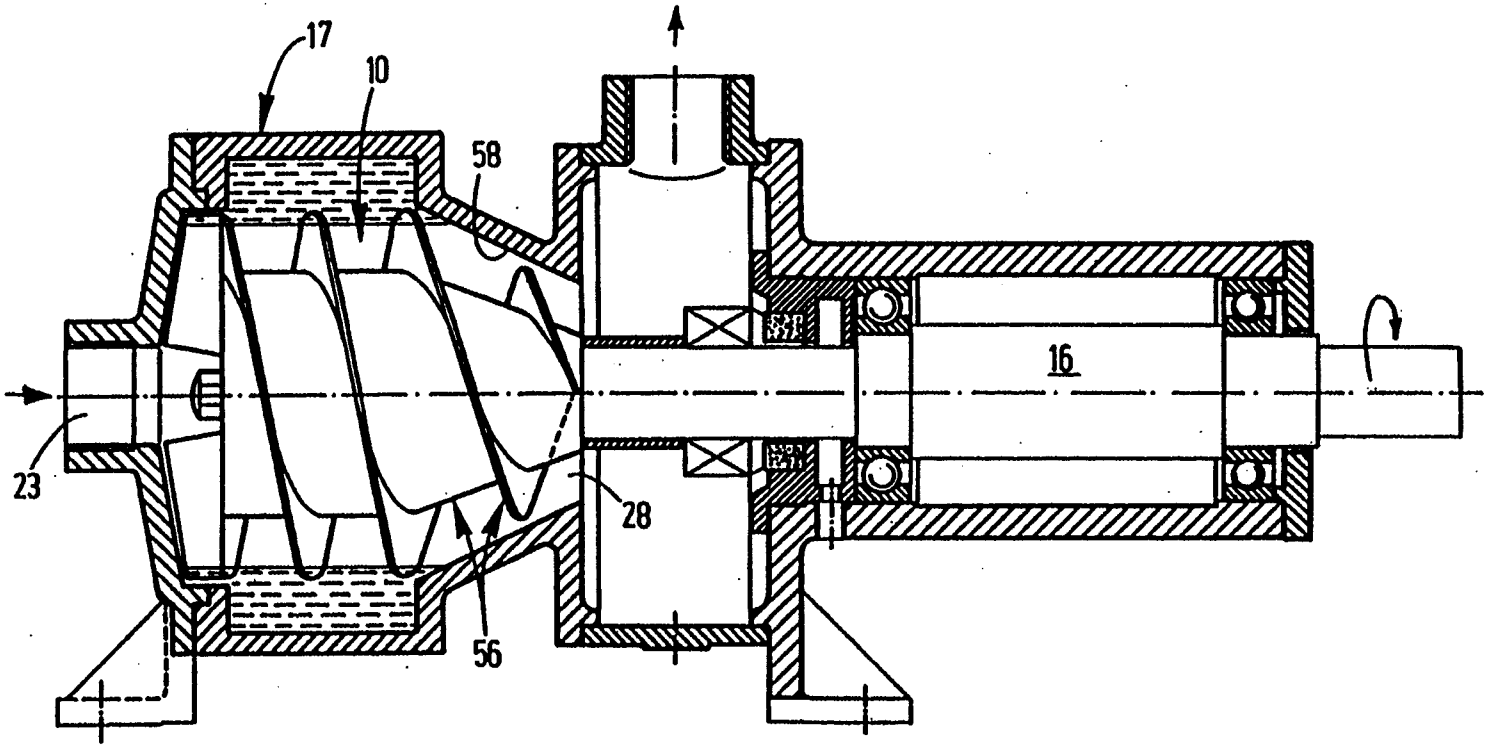
FIG. 6 shows a section in a second embodiment of the pump according to the invention.

FIG. 6 shows a second embodiment of the pump according to the invention, where the rotor 10 is suspended in only one bearing at the one spindle end 16, which results in a less space-demanding construction. This simplified embodiment has a central, axially-oriented influx, which at the same time constitutes the inlet opening 23, in that the suction plate simultaneously constitutes the one end wall of the pump housing 17. In this embodiment, the concentric, cone-shaped parts 56,58 on the rotor 10 and housing 17 are arranged in the area of the discharge opening 28. The distance between the edges of the blades 14, i.e. the part 56, and the part 58, is the normal clearance distance in the pump. There is thus an even transition from the largest section of the liquid ring in the rotor's cylindrical area to the discharge opening, which renders the pump particularly suitable for the pumping of fluids containing solid particles of high specific gravity in relation to the fluid. With the exception of the embodiment shown in FIG. 8, these cone-shaped parts can be used in all of the embodiments of the pump according to the invention described above and hereafter.

Figure 8:
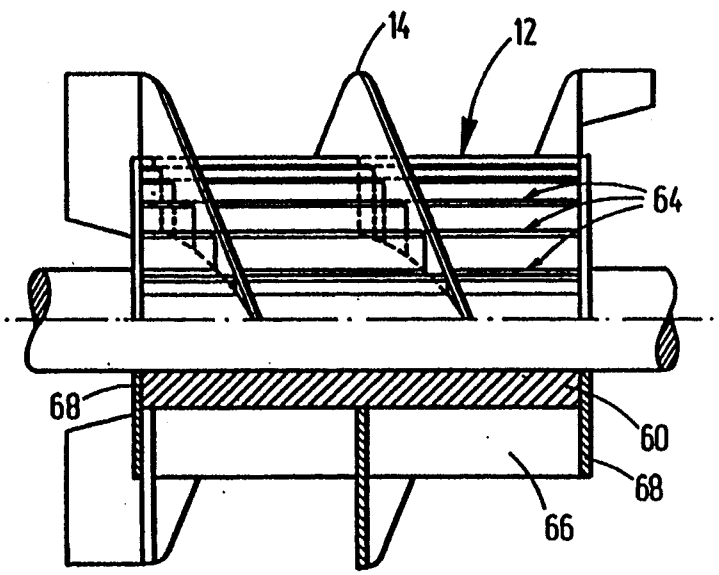
FIG. 8 shows a rotor according to the third embodiment partly in section.
Figure 7:
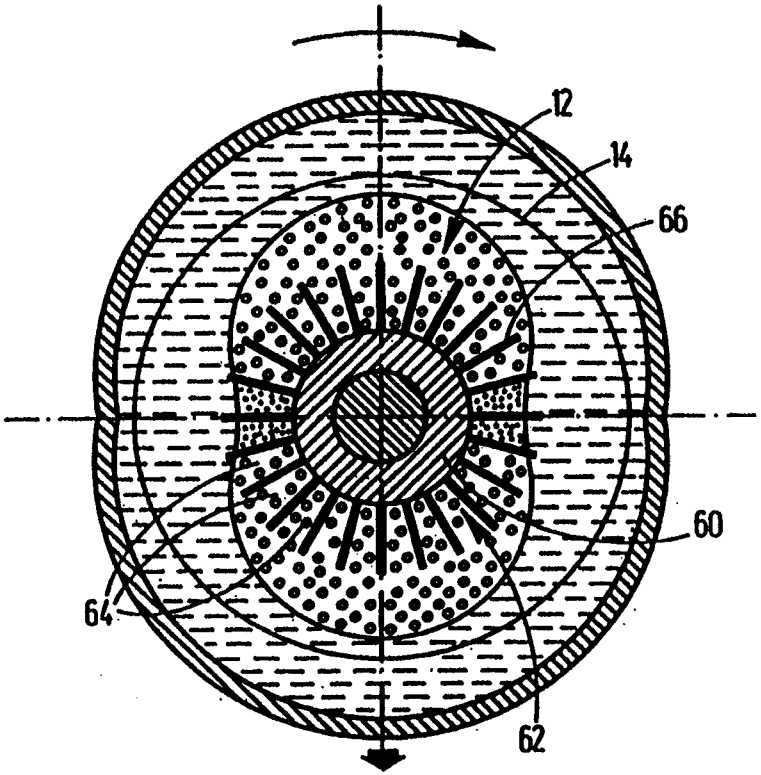
FIG. 7 shows a section through a third embodiment of the pump according to the invention.

In FIGS. 7 and 8 there is shown a third embodiment of the pump according to the invention. Here, the rotor has been modified, in that a part of the rotor hub 12 is configured with a cavity which is open outwardly in the radial direction. The hub 12, which has the same diameter as in the other embodiments, is thus divided into a central, solid part 60, and a part 62 provided with cells 64 which are formed by axially-oriented lamella 66 secured to the solid part 60. The blades 14 are here extended into and secured to the part 60. The lamella thus adjoin the innermost parts of the blades 14, which form the end walls in the cells 64. The cells 64 are gas-proof in all directions with the exception of radially outwards as shown, in that at the rotor ends the closing-off of the cells 64 is effected by means of the endplates 68. In the embodiment shown, the height of the lamella constitutes a half of the radius of the hub 12, where the diameter of the hub is equal to two thirds of the diameter of the rotor 10 across the blades. The height of the cells 64 can be varied, but the cell height must be at least 30% of the radius of the solid part 60. Moreover, here there are 24 cells seen in the same section through the rotor, but the number can be varied from eight and upwards, preferably between 11 and 31.

Figure 10:
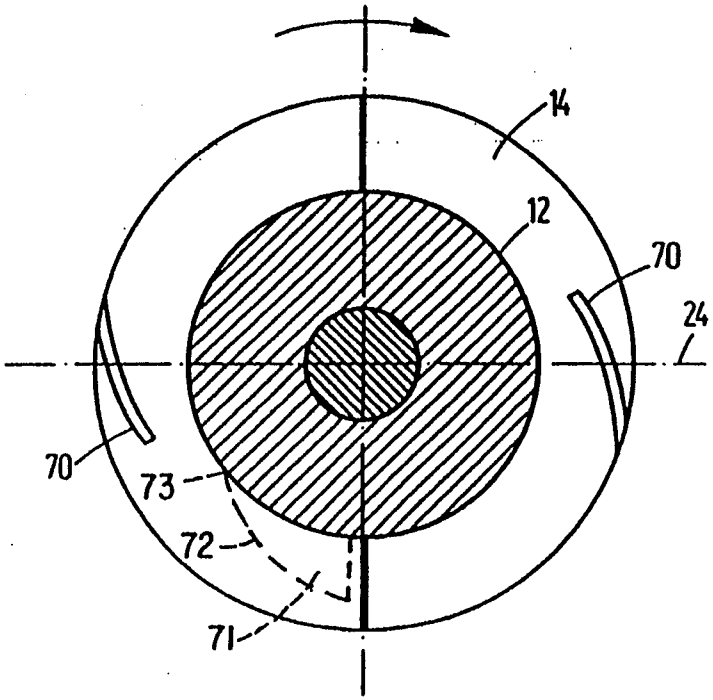

The advantage of this construction is that instead of being exposed to a strong braking effect, the liquid ring can deflect and continue into the cells, where it compresses the air or gas which will always exist in the cells 64, see FIG. 10. A part of the energy which will normally be used to create turbulence at the liquid's passage of the sealing line or sealing surface is accumulated as overpressure in the cells 64, and is released again after the passage of the sealing line. Together with the less disturbed course of flow, this contributes towards a reduction in the power consumption of the pump.

The configuration of the cells 64 by means of lamella 66 is the preferred embodiment, but other embodiments are possible, e.g. by the cutting of holes in an otherwise solid hub 12.

Figure 9:
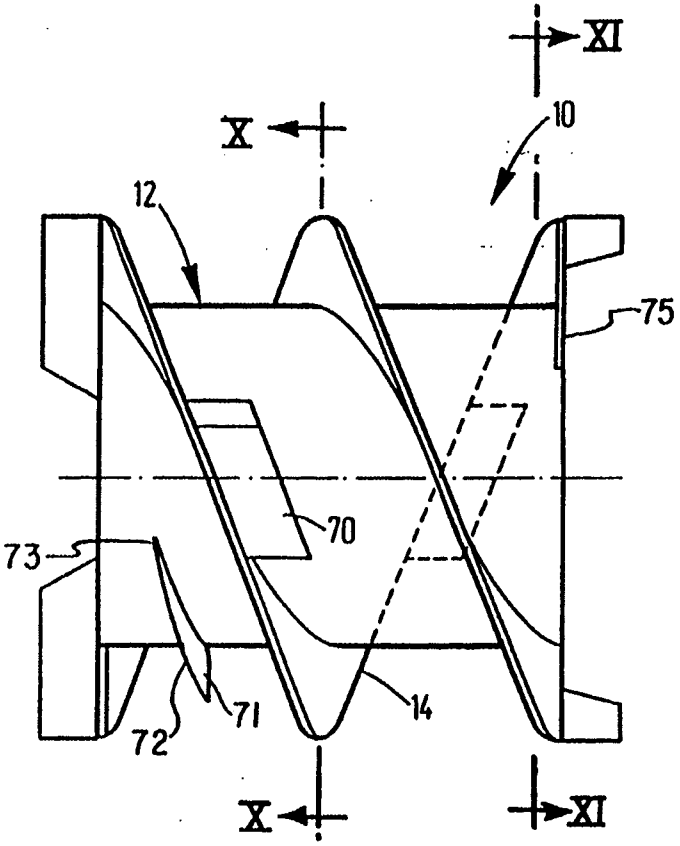
FIGS. 9 and 10 shows a rotor provided with carriers seen from the side and along the line X—X.

FIGS. 9 and 10 show a variant of the rotor for a pump according to the invention. Here, carriers in the form of light plastic plate elements 70 are provided on the sides of the blades 14. During rotation of the rotor 10, particles in the fluid are drawn in towards the hub 12. It is hereby possible for particles with a specific gravity greater than 1.5 to be conveyed in water, in that due to the centrifugal force, the particles will normally seek outwards towards the periphery and therefore outside the reach of the blades. This arrangement can be combined advantageously with the embodiment shown in FIG. 6, in that the carriers 70 can be provided on both the cylindrical part as well as the cone-shaped part of the rotor 10.

When pumping fluid containing lumps of solid material the hub 12 may be provided with one or more knives 71 as shown in FIGS. 9 and 10. The knives 71 have curved, sharp edges 72 extending parallely with the blades 14 from a position 73 close to the hub's surface and from there radially outward and against the rotational direction of the rotor. Thereby lumps may be reduced to sizes that do not obstruct the pump or other passages downstream. The number, size and position of knives 71 may be varied according to need.

Figure 11:
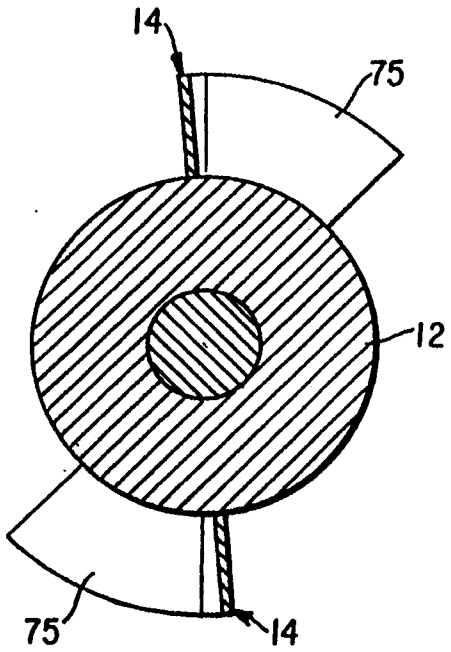
FIG. 11 shows a rotor variant in a section on the line XI—XI in FIG. 9.

A further embodiment of the blades 14 on the rotor is shown in FIG. 11. At the outlet end of the rotor each blade 14 is extended along the periphery of the rotor in a way to provide arcuate extensions 75 stretching in plane perpendicular to the rotor's axis of rotation. The arc covered by each extension 75 may preferably be 45°, but another value may be chosen. The extensions provide a limitation to the liquid flow through the pump, which may be wanted to reduce working liquid loss when pumping gases.

The pump according to the invention can be configured as a multi-stage pump with the same or different pump principles at the stages, and the pump can be made fully reversible by making the inlet and outlet openings of equal dimensions and changing the direction of rotation of the rotor. According to the invention, different embodiments as described above may be combined in various ways within the scope of the claims.

We claim:

1. A fluid ring pump comprising:

an elongated pump housing having an interior surface formed by an elongated planar section with edges intervening between at least two similar elongated, curved, opposed sectors mutually joined with the edges of the intervening elongated planar section along parallel transition lines;

a cylindrical rotor rotatably mounted within and on a housing longitudinal axis with its longitudinal axis symmetrical in relation to said sectors;

means for rotating said rotor in a first direction;

an inlet and an outlet in said housing for admitting and discharging the material being pumped, each at an opposite end of the rotor;

at least one helical blade mounted on and outwardly extending from said cylindrical rotor along its length to rotate therewith and move the material axially from the inlet to the outlet of the housing;

the interior surface of said housing facing the at least one helical blade and formed by said sectors such that the distance between said housing inner surface and the outer diameter of the said at least one helical blade varies along the length of the rotor longitudinal axis in a direction transverse to said rotor longitudinal axis; and each planar section of the housing interior surface extending in the direction of rotor rotation starting at the connecting transition line between adjoining sectors.

2. Pump according to claim 1, wherein the end of the rotor adjacent to the outlet and a corresponding surrounding part of the housing interior surface are frusto-conical, and the housing surrounding part is disposed symmetrically around the rotor axis of rotation.

3. Pump according to claim 1, wherein an extension of the said at least one blade at the outlet end of the housing is provided in a direction against the direction of rotor rotation, said extension extending perpendicularly to the rotor axis of rotation.

4. Pump according to claim 1, wherein there are a plurality of said helical blades and further comprising a hub on said rotor with said hub having an outer surface, and a plurality of knives each with a curved edge and each fitted to the hub between a pair of the helical blades, said knives extending substantially parallel with the blades and having in the direction of rotation of the rotor a decreasing distance between an edge of the knives and the outer surface of the hub.

5. Pump according to claim 1 wherein each of said housing sectors is in continuous curved form.

6. Pump according to claim 1 wherein each of said housing sectors has a cross-section corresponding to a part of a circle.

7. Pump according to claim 1, wherein the housing interior surface in the area of the inlet at a first end of the rotor has an annular surface which is concentric with the rotor axis of rotation.

8. Pump according to claim 7, wherein the housing interior surface in the area of the outlet at a second end of the rotor has an annular surface which is concentric with the rotor axis of rotation.

9. Pump according to claim 1, wherein the housing interior surface in the area of the outlet at a second end of the rotor has an annular surface which is concentric with the rotor axis of rotation.

10. Pump according to claim 9 further comprising an end of the rotor adjacent to the outlet and a corresponding surrounding part of the housing interior surface are of frusto-conical shape, and the housing surrounding part is disposed symmetrically around the rotor axis of rotation.

11. Pump according to claim 1, further comprising a curved plate carrier element on an end of the at least one blade secured to a side of the at least one blade and extending in the direction of blade rotation.

12. Pump according to claim 11, wherein there are a plurality of said blades and further comprising a plurality of knives each knife having a curved edge and fitted to the rotor between a pair of the helical blades, said knives extending substantially parallel with the blades and, as seen in the direction of rotation of the rotor, with decreasing distance between an edge of the knives and the surface of the rotor.

13. Pump according to claim 1, wherein the end of the rotor adjacent to the outlet is provided with a coverplate extending along the axial ends of the said at least one blade to a diameter which is greater than a diameter of the rotor, and the outlet has a diameter which is substantially the same as the rotor diameter.

14. Pump according to claim 13 wherein an extension of the at least one blade at the end of the rotor adjacent to the outlet is provided in a direction against the direction of rotation of the rotor, said extension extending perpendicularly to the axis of rotation of the rotor.

15. Pump according to claim 1 wherein said transition line on each side of the housing is included as part of a planar section.

16. Pump according to claim 1 wherein said planar sections are offset from each other relative to the rotor axis.

17. Pump according to claim 1, wherein the said housing interior surface at each planar section between the adjoining sectors in the direction of rotation of the said at least one blade extends at an angle to the rotor rotation to provide an abrupt reduction in the distance between the housing interior surface and the periphery of the at least one blade.

18. Pump according to claim 17, wherein the end of the rotor adjacent to the outlet is provided with a coverplate extending along the axial ends of the at least one blade to a diameter which is greater than a diameter of the rotor, and the outlet has a diameter which is substantially the same as the rotor diameter.

19. Pump according to claim 17 wherein an extension of said at least one blade at the outlet end of the housing is provided in a direction against the direction of rotor rotation, said extension extending perpendicularly to the rotor axis of rotation.

20. Pump according to claim 17, wherein each said planar section extends in a direction at an opposite angle from a diametrical line through the rotor axis to offset the housing sectors from each other relative to said diametrical line.

21. Pump according to claim 1, wherein the rotor has distributed around its circumference in a given section a plurality of cells which are open in the radial direction from the rotor axis of rotation.

22. Pump according to claim 21, wherein the rotor has a hub with an inner and an outer diameter and the cells are formed by a plurality of lamella symmetrically located around the rotor and extending out to the hub outer diameter, said lamella extending parallel with the axis of rotation and said at least one blade extending closer to said housing interior surface than said lamella.

23. Pump according to claim 22 wherein the ratio between the hub outer diameter and hub inner diameter located at the bottom of the cell is at least 3:1.

24. Pump according to claim 21, wherein the rotor has a hub with an outer diameter, an inner diameter and an end forming said section and the section has at least eight cells which are open in the radial direction away from the rotor axis of rotation, and which have gasproof walls, where the ratio between the outer diameter of the hub and the hub's inner diameter measured at the bottom of the cells in the section is at least 1:3.

25. Pump according to claim 24, wherein the cells are formed by lamella on and distributed symmetrically around the hub and extending out to the end of the hub, said lamella extending continuously and parallel with the rotor axis of rotation, said at least one blade extending closer to the housing interior surface than the lamella.

26. Pump according to claim 21 wherein the number of cells is in the range from 8 to 31.

27. Pump according to claim 26 wherein there are between 11 and 31 cells.

* * * * *